US007017290B2

(12) United States Patent
Bontems et al.

(10) Patent No.: US 7,017,290 B2
(45) Date of Patent: Mar. 28, 2006

(54) IRON WITH AN OPEN REAR CAVITY

(75) Inventors: Cedric Bontems, Villeurbanne (FR); David Hilary Powell, London (GB); Edgar Hipp, Chazay D'Azergues (FR); Bernard Dugelay, Chaponnay (FR)

(73) Assignee: SEB S.A., Ecully Cedex (FR)

( * ) Notice: Subject to any disclaimer, the term of this patent is extended or adjusted under 35 U.S.C. 154(b) by 0 days.

(21) Appl. No.: 10/889,021

(22) Filed: Jul. 13, 2004

(65) Prior Publication Data

US 2004/0237357 A1 Dec. 2, 2004

Related U.S. Application Data

(62) Division of application No. 10/433,353, filed as application No. PCT/FR02/03284 on Sep. 26, 2002, now Pat. No. 6,807,757.

(30) Foreign Application Priority Data

Oct. 2, 2001 (FR) ..... 01/12671

(51) Int. Cl.
*D06F 75/30* (2006.01)

(52) U.S. Cl. ..... 38/88

(58) Field of Classification Search ..... 38/75, 38/77.4, 77.5, 77.8, 77.81, 77.82, 88, 90, 38/91, 92

See application file for complete search history.

(56) References Cited

U.S. PATENT DOCUMENTS

| | | | | | |
|---|---|---|---|---|---|
| 371,227 | A | * | 10/1887 | Swann | 38/92 |
| 2,201,601 | A | | 5/1940 | Webster | |
| 2,207,669 | A | | 7/1940 | Huffman | |
| 2,427,521 | A | * | 9/1947 | Butman | 38/77.81 |
| 2,762,143 | A | * | 9/1956 | Hoecker | 38/77.5 |
| 2,769,258 | A | * | 11/1956 | Hoecker | 38/77.82 |
| 2,786,287 | A | * | 3/1957 | Swann | 38/77.4 |
| 3,418,736 | A | * | 12/1968 | Kueser | 38/77.81 |
| 5,926,983 | A | * | 7/1999 | Tee et al. | 38/77.82 |

FOREIGN PATENT DOCUMENTS

| | | |
|---|---|---|
| DE | 81 15 797.5 | 9/1981 |
| DE | 38 43 384 | 7/1990 |
| FR | 1 318 304 | 2/1963 |

* cited by examiner

*Primary Examiner*—Ismael Izaguirre
(74) *Attorney, Agent, or Firm*—Browdy and Neimark, PLLC

(57) ABSTRACT

A pressing iron having, from bottom to top, a heating soleplate, a body delimited by an envelope that contains a water reservoir, and a gripping handle connected to the body. The reservoir is provided with a vent at the rear of the iron and at the top of the reservoir, the iron is provided with an opening situated at the front of the iron above the reservoir, and the iron further has a tube connecting the vent to the opening.

7 Claims, 4 Drawing Sheets

20
202
7
22
10

202
20
22
7
10

202
201
22
20
10

7
20

IRON WITH AN OPEN REAR CAVITY

CROSS-REFERENCE TO RELATED APPLICATION

This is a division of U.S. application Ser. No. 10/433,353, filed on Jun. 2, 2003, which is a 371 of PCT/FR02/03284, filed Sep. 26, 2002, the disclosure of which is incorporated herein by reference.

BACKGROUND OF THE INVENTION

The present invention concerns pressing irons.

One distinguishes in a schematic manner and from bottom to top of irons, a flat soleplate, a body envelope for active thermal, electric and possibly hydraulic parts, and a handle for manipulating the iron.

The handle is fixed to the rest of the appliance by attachments at the front and/or rear of the iron. In existing versions, the parts, for example molded, make up the parts of the envelope body and of the handle in such a manner that there does not exist a discontinuity between this body and this handle.

The lighter irons only have a connection at the front or at the rear, and the handle is found in a cantilever arrangement as in U.S. Pat. No. D415,865, which leads to reinforcing the single connection with the body of the iron, and is not suitable for heavier irons.

The largest irons have a connection of the handle to the body at the front of the iron and at the rear. It follows that the heel of the iron assumes substantial proportions that are unattractive and costly in material. Efforts have been made to remedy this drawback. The U.S. Pat. No. D428,228 shows an iron in which the connection of the handle to the body is made lighter. The insufficient stability of this iron placed on its heel has required the addition of a ring that augments the polygon of the stability, but also the costs. The U.S. Pat. No. D441,925 shows an iron in which the rear connection of the handle by the heel is made lighter but the stability of the iron on its heel necessitated forming a curvilinear polygon for support of the heel which is poorly integrated to the rest of the iron. Such a polygon for support of the iron on its heel is found in numerous designs such as that of the model DM/046388. But these designs resolve the problem of the stability of the iron on its heel better when the polygon obtained is large and they are insufficient to lighten the heel of the iron while providing a substantial place for gripping. Other designs show heels of an iron having a cavity at the rear of the heel. These are often cavities required by the connection of the cordless iron on its support. But these cavities do not increase the space for gripping the handle, or diminish the massive aspect of the iron or its material costs.

BRIEF SUMMARY OF THE INVENTION

The object of the invention hereafter is a pressing iron whose handle has at the rear of the iron a connection to the rest of the body of the appliance which provides a maximum of room for manually gripping the iron by the handle, while preserving a good stability of the iron on its heel and the solidity of the connection.

The goal of the invention is achieved by a pressing iron having from bottom to top a heating soleplate, a body delimited by an envelope, a gripping handle connected by its rear end to the body of the iron noteworthy in that the rear connection is mainly composed of at least two arms extending in a substantially symmetrical manner with respect to the median plane of the iron from the handle while diverging to the body of the iron and providing between them an open space.

The arms can be light, of small cross-section, and of small size, thus leaving a maximum space for holding by the handle. They provide between them a space or a cavity open in the longitudinal direction toward the rear on the one hand and toward the handle on the other hand. Viewed from the rear of the iron, the structure obtained is substantially triangular, which renders it very rigid, and relieves, when it exists, the front connection of the handle with the body from torque induced by the hand. This structure is particularly well adapted to transmit to the iron lateral movements of the hand oscillating in a horizontal plane.

Advantageously, the arms are disposed in a manner to generate with the rear of the body a support plane for the iron placed on its heel.

The base of the iron placed on the heel is created by the arms and the bottom of the body, which gives the iron a maximum foundation. A recess formed in the surface for supporting the iron on its heel permits the passage of the power cord when the iron is on its heel.

In a version of the iron according to the invention having a power cord, the outlet thereof is situated in the open space.

In this arrangement, the arms naturally limit deflection of the power cord at the outlet of the body which avoids overly pronounced twisting.

Advantageously, when an iron according to the invention has a power cord, the dimensions of the open space permit the cord to be folded therein and housed with its plug, during storage of the appliance.

Placement or storage is facilitated by the fact that one threads the power cord in the cavity and the arms while avoiding bulging.

The cavity can be arranged for this purpose and has orifices in which one can insert the prongs of the plug. The orifices can be arranged on one of the arms or on a protuberance especially designed for this use.

Usefully, when the iron is a steam iron furnished with a cup for refilling with water, the dimensions of the open space permit housing of the cup, possibly at the same time as the power cord which it contributes to holding in place.

In one version according to the invention of an iron not having a power cord, the iron has connection contacts on the inner wall of the open space.

Usefully, the form of the open space is adapted to that of a support on which it is intended to place the iron.

Thus, the support placed on the working plane is no longer in contact with the hot soleplate. The materials making up the support can be more economical.

According to another version, the dimensions of the open space permit it to receive a funnel intended for refilling a water reservoir of the pressing iron.

The reservoir situated in the body extends from the front toward the rear of the appliance. Filling is made easier. In effect, one then disposes of sufficient space to house a funnel that is large with respect to those that can be formed at the front of the appliance.

The funnel is preferably higher then the reservoir which cannot be emptied by this accessory in the normal position.

In one version, the funnel is furnished with an obturator.

The obturator can be for example a plug that is manually removable, or a pivoting valve that can be closed, at least when the iron is disposed on its heel, in a manner to prevent water in the reservoir from exiting through the funnel.

Preferably, the funnel is connected to the reservoir at the front of the appliance.

The connection at the front prevents the reservoir from emptying when the iron is placed on its heel. In this position, in effect, water collects close to the heel. The connection of the funnel to the reservoir then opens on an air space and the reservoir cannot be emptied through the connection.

BRIEF DESCRIPTION OF THE DRAWINGS

The invention can be better understood in view of the examples herebelow and the attached drawings.

DETAILED DESCRIPTION OF THE INVENTION

Figure 1:
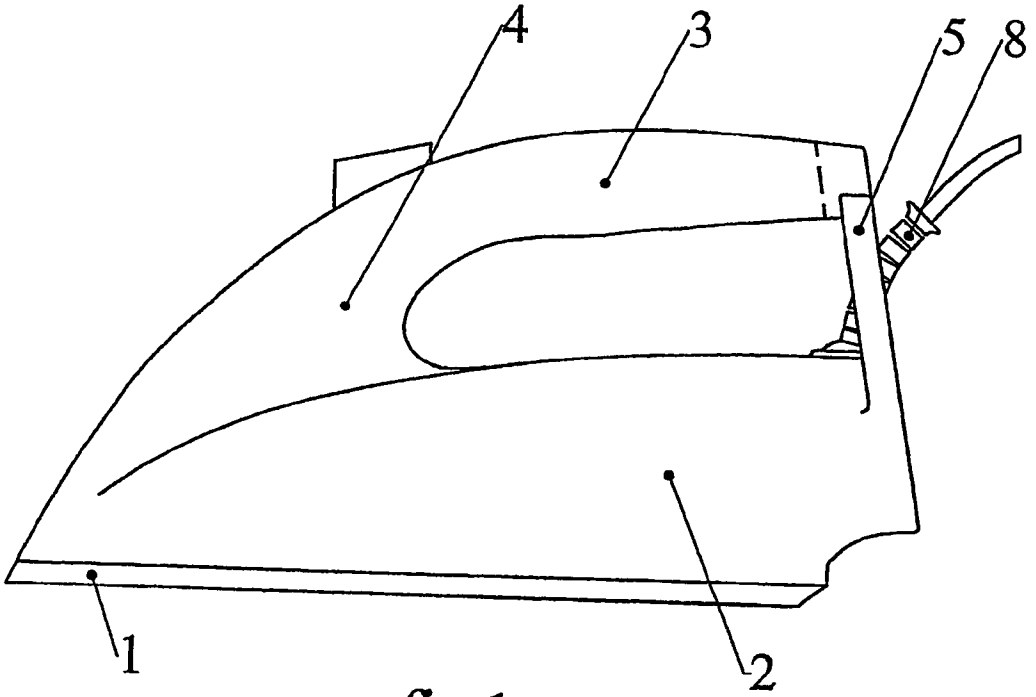
FIG. 1 is a longitudinal view of a first pressing iron according to the invention.
Figure 2:
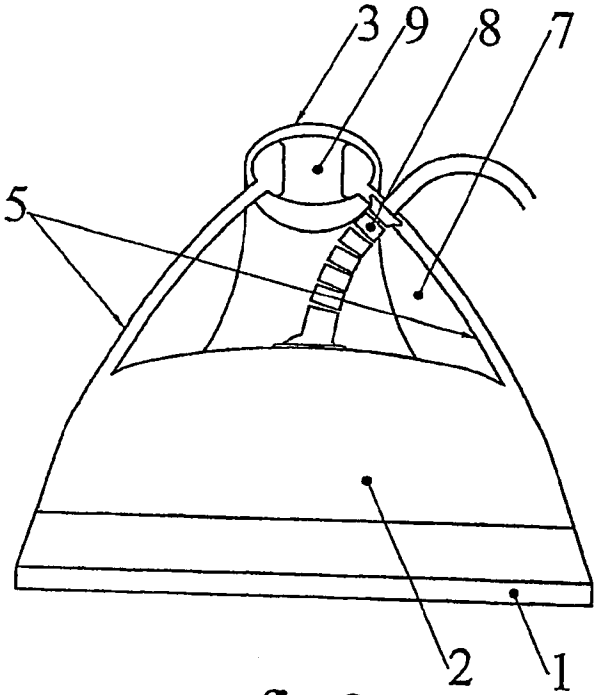
FIG. 2 is a rear view of the iron of FIG. 1.

In a form of construction shown in FIGS. 1–2, a pressing iron has a heating soleplate 1, a body 2, a handle 3. Handle 3 is connected to body 2 at the front of the iron in a known fashion by a foot 4 prolonging one end of the handle. Advantageously, this foot 4 is hollow to contain components of the iron, and the walls thin. Handle 3 is connected by the other end to body 2 at the rear of the iron by two arms 5 extending while diverging from handle 3 to the body of the iron so that the structure obtained is substantially triangular. The contour of the rear end of handle 3, arms 5 and body 2, clearly visible in FIG. 2 and referred to by 6 in FIG. 5 of an industrial form of construction, forms a flat polygon at the rear of the iron, a polygon by which the iron is supported on the working plane when it is placed on its heel at times other than during active ironing sequences. Arms 5 delimit between themselves a space 7 situated between handle 3 and body 2, open toward the front and rear, where the folded power supply cord, when it is present, can be stored.

The structure of arms 5 permits foot 4, which does not receive torsion forces, to be made lighter. Arms 5 can be of small cross section which frees the space available on the handle for gripping. By diverging toward the body of the iron, the arms increase by a maximum the base of the iron placed on its heel, improving its stability.

Figure 5:
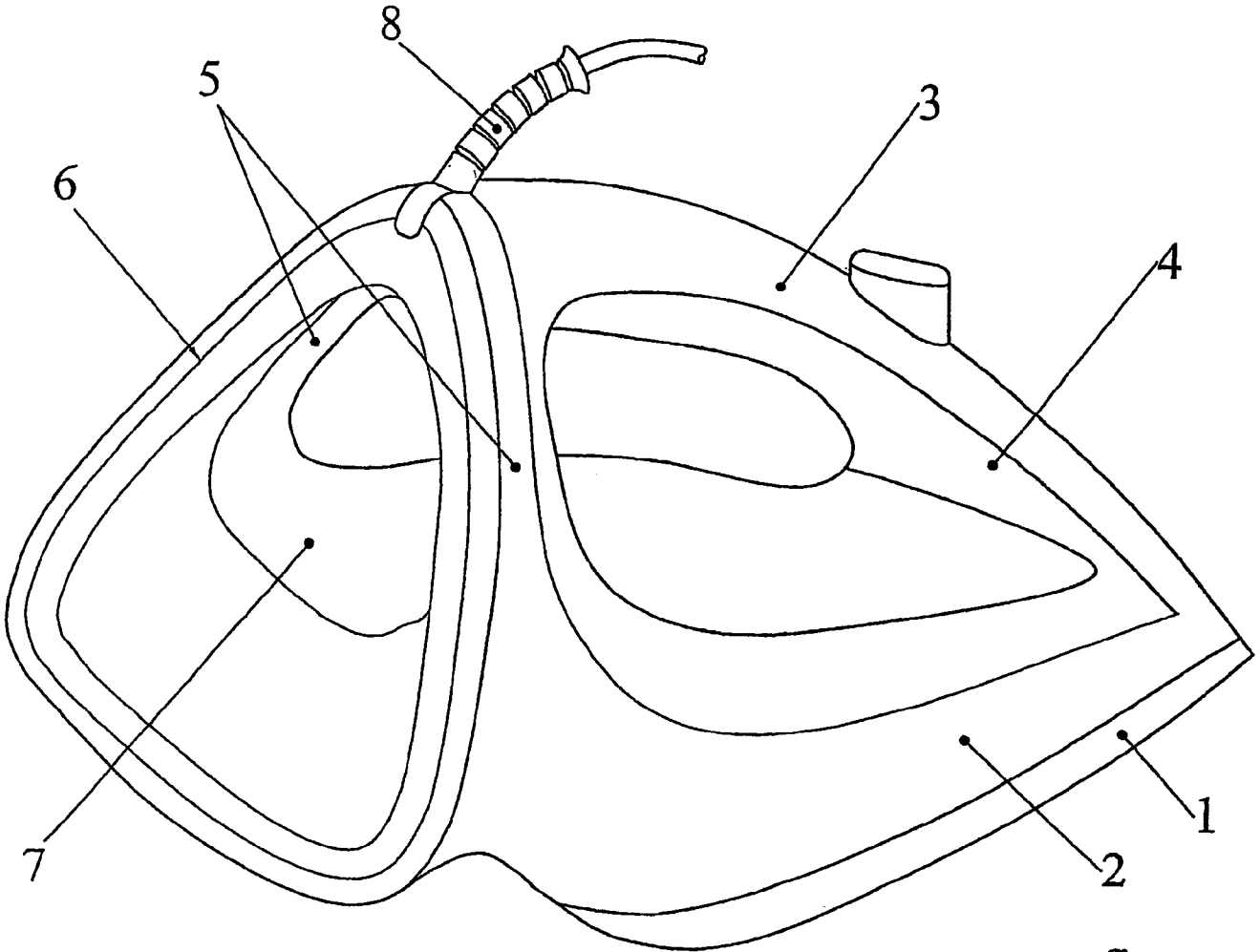
FIG. 5 is a perspective view of the industrial model of a third pressing iron according to the invention.

Advantageously, space 7 can be extended toward the bottom in body 2 to the rear of the iron as shown in FIG. 5 of an industrial form of construction, which on the one hand facilitates storage of the power cord, and on the other hand improves the stability of the iron placed on its heel. In effect, an obstacle, for example a fold in the fabric, being located in the base, is positioned in cavity 7 and does not impair the equilibrium of the iron.

Irons having a power cord can have a cord outlet 8 installed conventionally at the rear of handle 3 as visible in FIG. 5. In the version of FIGS. 1–2, the outlet of the power cord is advantageously installed on body 2 in cavity 7 to directly supply the active components. The arms naturally limit deflection of the power cord at the outlet 8, which diminishes flexure stresses thereon and increases the useful life. The arms eliminate all risk of catching of the cord on the handle during ironing. A recess 9 is formed at the rear of the iron to permit passage of the cord of the iron placed on its heel.

In a cordless version of the iron not shown, cavity 7 is advantageously used to receive contacts for connection of the iron to its support. Advantageously, the contacts are disposed in cavity 7 laterally on arms 5 and/or on body 2 in a manner to not create any withdrawal force after engagement of the iron on the support.

Figure 3:
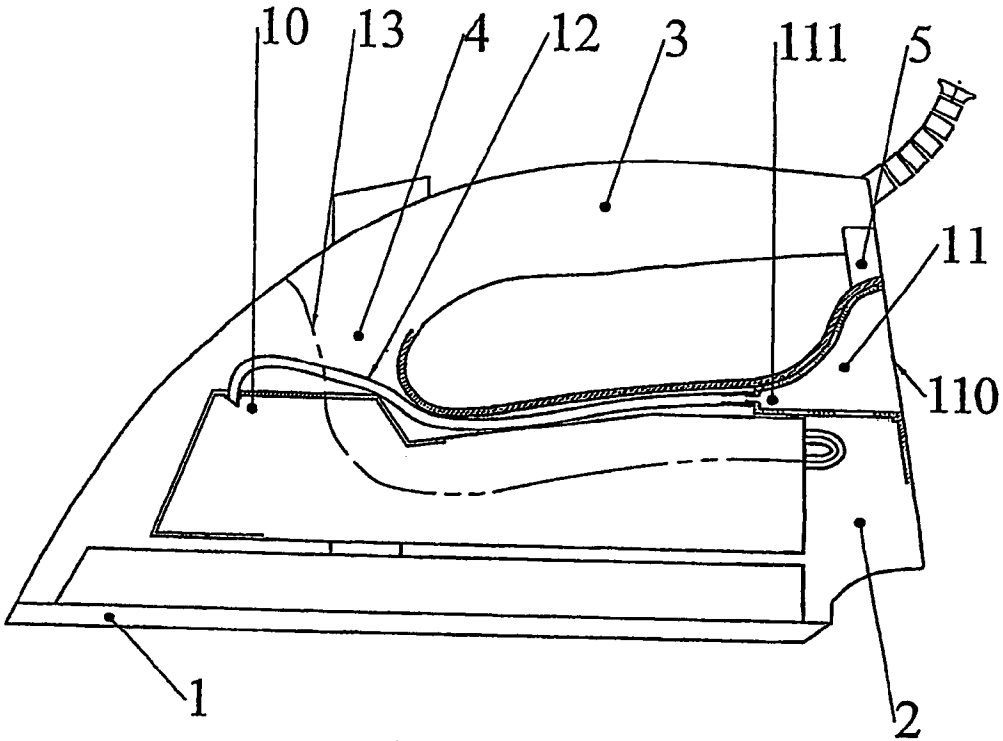
FIG. 3 is a longitudinal view of a second pressing iron according to the invention, in partial cross-section along the plane of symmetry of the appliance.
Figure 4:
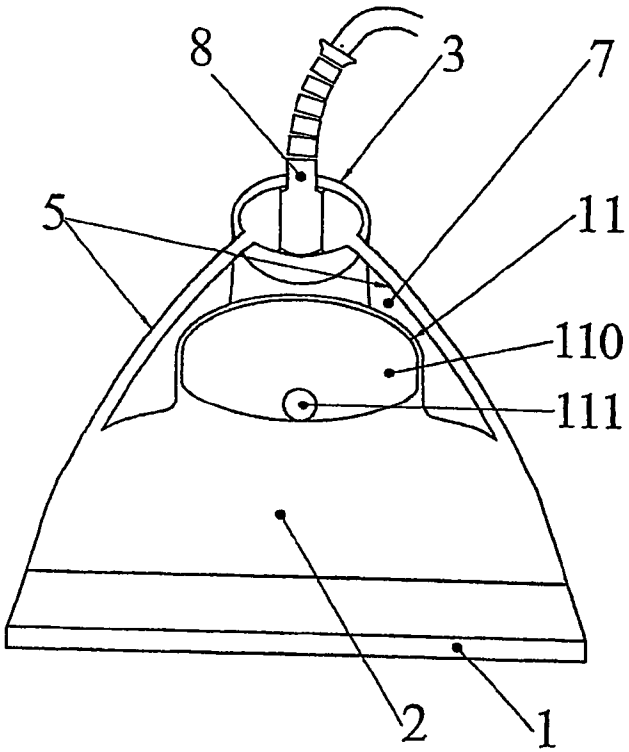
FIG. 4 is a rear view of the iron of FIG. 3.

In a form of constructions visible in FIGS. 3–4, the pressing iron has a soleplate 1, a body 2 containing a water reservoir 10, a handle 3 connected to body 2 at the front of the iron by a foot 4 and at the rear of the iron by two arms 5 disposed as in the preceding arrangements while providing a space 7 between them. Space 7 houses a funnel 11 whose large opening 110 is directed toward the rear and whose large edge is flush with or is recessed from the plane of support of the iron on its heel. The small opening 111 of funnel 11 is directed toward the front of the iron and it is connected to the front of reservoir 10 by a tube 12. Reservoir 10 is moreover furnished with a vent at the rear of the iron and at the top of the reservoir. The vent is connected by a tube having an axis 13 to an opening situated at the front of the iron above reservoir 10. The fixed funnel is housed in an extension of body 2 in space 7. Reservoir 10 is, inter alia, intended to contain water for the steam necessary for ironing.

The homemaker can easily refill water reservoir 10 by holding his or her pressing iron vertically, tip to the bottom, via funnel 11 whose large opening cross section 110 is accessible in this position, at the rear of the iron between arms 5. Water flows into reservoir 10 through tube 12 and air in the reservoir is expelled by the refilling water, which escapes through the vent and tube 13. When the homemaker rests his or her iron in the normal ironing position, or places it on its heel, the arrangement of the water inlet and the vent prevent the water from escaping.

In a similar version not shown, funnel 11 can pivot in body 2 of the iron around a transverse axis passing through the connection of small orifice 111 to pipe 12, and thus be retracted, thus making available the place for storing the power cord in the space 7.

Figures 6, 7, 8, 71:
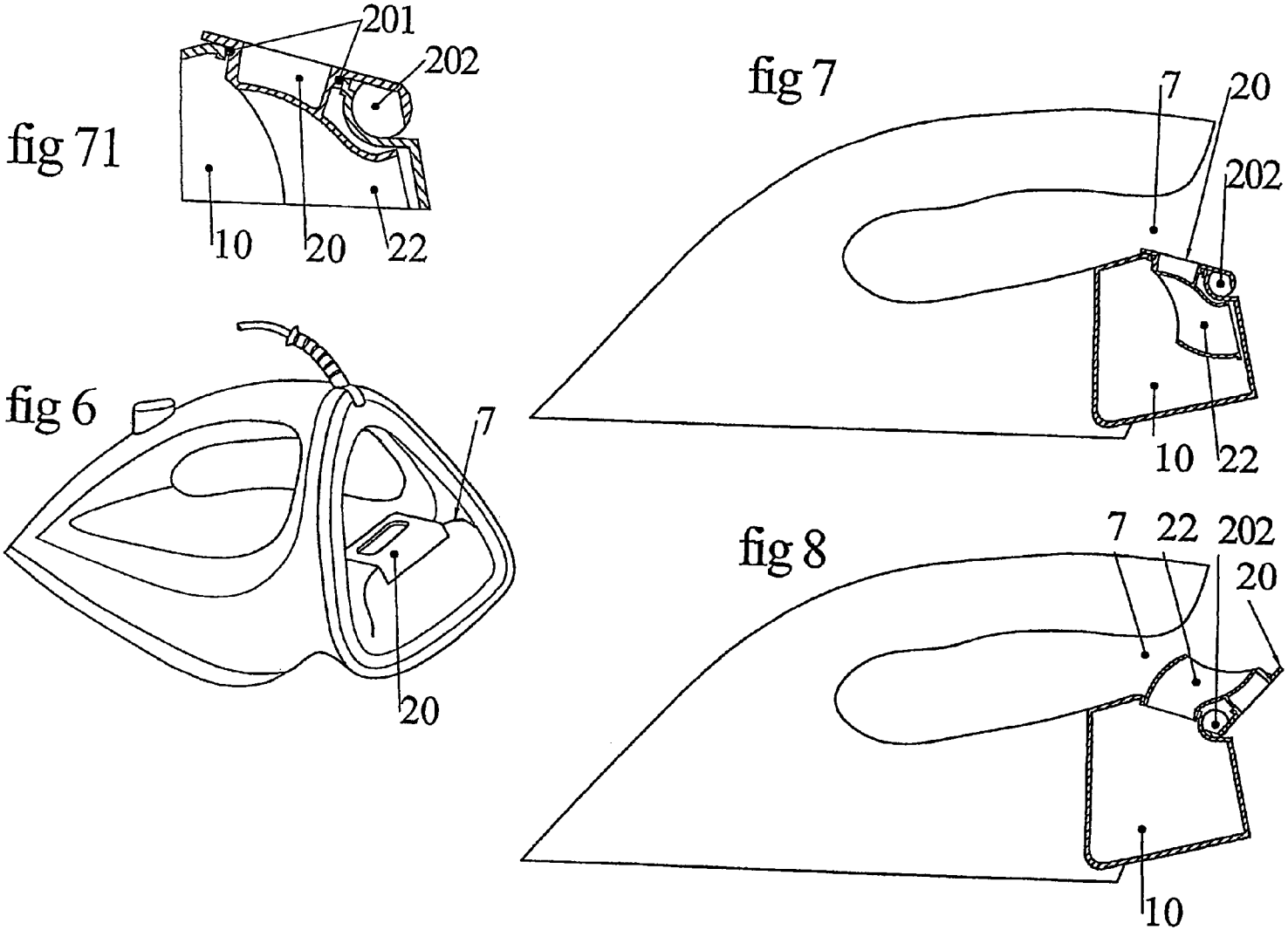
FIG. 6 is a perspective view of the industrial model of a fourth pressing iron according to the invention having a device for filling the reservoir at the rear of the iron.
FIG. 7 is a longitudinal, schematic cross-section of the iron of FIG. 6, the filling device being closed.
FIG. 8 a longitudinal schematic cross-section of the iron of FIG. 6, the filling device being open.
FIG. 71 is an enlarged detail of FIG. 7.

In a version similar that of FIG. 5 and shown in FIGS. 6 to 8 and 71, the iron has a water reservoir 10 the filling of which is effectuated through an orifice opening into space 7, this orifice being provided with means for receiving and guiding the liquid through the orifice toward reservoir 10, said means passing through the orifice and being movable in rotation between a first open position visible in FIG. 8 where the liquid can be introduced and a second closed position visible in FIG. 7 where said means are retracted into reservoir 10 and assuring closing of the orifice.

The means for receiving and guiding the liquid comprise a rotatable shutter 20 assuring closing and sealing of the orifice by a joint 201 better shown in FIG. 71, and a funnel form 22 integral with the rotatable shutter. The shutter is provided with bearings 202 creating an axis of rotation substantially parallel to one edge of the refilling orifice.

The funnel form is adapted to the form of the orifice and its axis of rotation selected to provide a maximum water passage and to present a water inlet that is freed from the handle. In order to do this, the axis of rotation is made horizontal, close to the rearmost edge of the orifice in space 7.

By these means, the user by opening shutter 20, which causes funnel 22 to suddenly appear, can easily refill its water reservoir. After closing of the shutter, the funnel is retracted into the reservoir and no longer occupies space 7 available for other uses, to store the power cord at the end of ironing for example.

As one can note from reading the preceding, the structure of the iron according to the invention presents numerous advantages.

What is claimed is:

1. A pressing iron comprising, from bottom to top, a heating soleplate, a body delimited by an envelope, said envelope containing a water reservoir, and a gripping handle connected to said body, wherein said reservoir is provided with a vent at the rear of said iron and at the top of said reservoir, said iron is provided with an opening situated at the front of said iron above said reservoir, said iron further comprises a tube connecting said vent to said opening, said gripping handle has a rear end connected to said body by a connection that is mainly composed of at least two arms extending in a substantially symmetrical manner with respect to the median plane of the iron from said handle while diverging to said body to provide an open space between said arms, said iron is provided with an orifice opening into the open space and communicating with said reservoir, and said reservoir is filled through said orifice.

2. The pressing iron of claim 1, wherein said orifice is provided with means for receiving and guiding water through said orifice toward said reservoir.

3. The pressing iron of claim 2, wherein said means for receiving and guiding water pass through through said orifice and are movable in rotation between a first open position to allow water to be introduced and a second closed position in which said means are retracted into said reservoir and assure closing of said orifice.

4. The pressing iron of claim 3, wherein said means for receiving and guiding water comprise a rotatable shutter assuring closing and sealing of said orifice, and a funnel element fixed to said rotatable shutter.

5. A pressing iron comprising, from bottom to top, a heating soleplate, a body delimited by an envelope, said envelope containing a water reservoir, and a gripping handle connected to said body, wherein said reservoir is provided with a vent at the rear of said iron and at the top of said reservoir, said iron is provided with an opening situated at the front of said iron above said reservoir, and said iron further comprises a tube connecting said vent to said opening, wherein said gripping handle has a rear end connected to said body by a connection that is mainly composed of at least two arms extending in a substantially symmetrical manner with respect to the median plane of the iron from said handle while diverging to said body to provide an open space between said arms, and said open space is dimensioned to permit said open space to receive a funnel provided for filling said water reservoir.

6. A pressing iron comprising, from bottom to top, a heating soleplate, a body delimited by an envelope, said envelope containing a water reservoir, and a gripping handle connected to said body, wherein said reservoir is provided with a vent at the rear of said iron and at the top of said reservoir, said iron is provided with an opening situated at the front of said iron above said reservoir, and said iron further comprises a tube connecting said vent to said opening, wherein said gripping handle has a rear end connected to said body by a connection that is mainly composed of at least two arms extending in a substantially symmetrical manner with respect to the median plane of the iron from said handle while diverging to said body to provide an open space between said arms, said pressing iron further comprising a funnel disposed in said open space for filling said water reservoir, and an obturator associated with said funnel to prevent water in said reservoir from exiting through said funnel.

7. The pressing iron of claim 6, further comprising a conduit connected between said reservoir, at a location at the front of said iron, and said funnel.

* * * * *